US008678849B2

(12) United States Patent
Yang et al.

(10) Patent No.: US 8,678,849 B2
(45) Date of Patent: Mar. 25, 2014

(54) ELECTRIC CONNECTOR HAVING GUIDING GROOVES EXTENDING TO A CONCAVE PORTION FROM TWO DIRECTIONS

(75) Inventors: Chung-Da Yang, Miaoli County (TW); Ray-Tang Sun, Miaoli County (TW)

(73) Assignee: UER Technology Corporation, Miaoli Country (TW)

( * ) Notice: Subject to any disclaimer, the term of this patent is extended or adjusted under 35 U.S.C. 154(b) by 26 days.

(21) Appl. No.: 13/567,381

(22) Filed: Aug. 6, 2012

(65) Prior Publication Data

US 2013/0171887 A1 Jul. 4, 2013

(30) Foreign Application Priority Data

Dec. 30, 2011 (TW) ..... 100225146 U

(51) Int. Cl.
*H01R 13/64* (2006.01)

(52) U.S. Cl.
USPC ..... 439/374

(58) Field of Classification Search
USPC ..... 439/374–378, 352–358, 682
See application file for complete search history.

(56) References Cited

U.S. PATENT DOCUMENTS

| | | | | |
|---|---|---|---|---|
| 6,375,515 | B1 * | 4/2002 | Higuchi | 439/676 |
| 6,953,357 | B2 * | 10/2005 | Fukushima et al. | 439/271 |
| 8,342,875 | B2 * | 1/2013 | Takeuchi | 439/374 |
| 8,398,425 | B2 * | 3/2013 | Suzuki et al. | 439/374 |
| 2013/0177800 | A1 * | 7/2013 | Yang et al. | 429/162 |
| 2013/0178079 | A1 * | 7/2013 | Yang et al. | 439/78 |

* cited by examiner

*Primary Examiner* — Chandrika Prasad
(74) *Attorney, Agent, or Firm* — Muncy, Geissler, Olds & Lowe, P.C.

(57) ABSTRACT

An electric connector is provided, including a first insulating body and a plurality of conductive terminals. The first insulating body includes two positioning grooves and a plurality of terminal grooves. Each positioning groove has a first socket and a second socket. A concave portion, a first guiding groove, and a second guiding groove are disposed at a groove wall of each positioning groove. The first guiding groove extends from the first socket in a first direction to the concave portion. The second guiding groove extends from the second socket in a second direction to the concave portion. The terminal grooves are disposed at an interval between the two positioning grooves. Each terminal groove has a third socket and a fourth socket. The conductive terminals are disposed individually in the terminal grooves. A joint connector is capable of being plugged into the electric connector in the first or second direction.

7 Claims, 4 Drawing Sheets

ELECTRIC CONNECTOR HAVING GUIDING GROOVES EXTENDING TO A CONCAVE PORTION FROM TWO DIRECTIONS

CROSS-REFERENCES TO RELATED APPLICATIONS

This non-provisional application claims priority under 35 U.S.C. §119(a) on Patent Application No. 100225146 filed in Taiwan, R.O.C. on 2011 Dec. 30, the entire contents of which are hereby incorporated by reference.

BACKGROUND OF THE INVENTION

1. Technical Field

The present invention relates to an electric connector, and more particularly to an electric connector that can be plugged bi-directionally.

2. Related Art

In recent years, the rapid development of electronic technology has exceeded popular imagination considerably. The functions of many electronic devices remain unknown to customers before the electronic device become commercially available. Consequently consumer electronics manufacturers already play the role of creating market demand by supplying products according to market demand. Additionally, an emerging new electronic device can even change the social activities of many customers. For example, the widespread use of smart mobile phones with mobile Internet access has demonstrably changed the social activities of the public.

When selecting portable electronic devices, customers not only focus on high-speed Internet access and multimedia playback functions, but also pay attention to portability. To make a portable electronic device having functions analogous to those of a personal computer, in addition to the improvement of the Integrated Circuit (IC) technology, it is also necessary to further enhance the energy density of the battery. Energy density refers to the electric power supplied by a unit volume or weight of the battery. Therefore, without reducing the capacity of the battery, the energy density of the battery can be effectively enhanced by reducing the volume and weight of the battery, facilitating its application to a portable electronic device. Currently, the most widely selected power supply source for portable electronic devices is a lithium battery.

As discussed, to reduce the volume of a portable electronic device, currently some manufacturers already join a lithium battery on a main board directly in a soldering manner (for example, resistance spot welding, ultrasonic welding, laser spot welding, and a conductive medium welding type soldering). That is, the original detachable manner is changed into an undetachable manner such that the lithium battery is built directly in a portable electronic device. Although such a manner definitely reduces the volume of the portable electronic device, if a process defect occurs in the joint process (for example, a defect occurs to the lithium battery or the main board), the rework cannot be performed in accordance with the conventional design, with the result that the lithium battery and the main board must both be scrapped. Additionally, when a client sends a defective product to the factory for repair, if it is discovered that the defect only affects either the lithium battery or the main board, the rework cannot be performed either, due to the conventional fabrication manner, with the result that the lithium battery and the main board must both be scrapped.

Therefore, when soldering technology is used to connect the lithium battery and the circuit board, rework is impossible or is difficult, resulting in the necessity of an alternative solution.

SUMMARY

In view of this, the present invention provides an electric connector, including a first insulating body and a plurality of conductive terminals. The first insulating body includes two positioning grooves and a plurality of terminal grooves. Each positioning groove has a first socket and a second socket. A first guiding groove, a second guiding groove, and a concave portion are disposed at a groove wall of each positioning groove. The first guiding groove extends from the first socket in a first direction to the concave portion. The second guiding groove extends from the second socket in a second direction to the concave portion. The terminal grooves are disposed at an interval between the two positioning grooves. Each terminal groove has a third socket and a fourth socket. The plurality of conductive terminals is disposed individually in the terminal grooves.

The present invention also provides an electric connector, and in addition to the above features, the electric connector further includes a second insulating body and a plurality of metal pins. The second insulating body includes two positioning boards correspondingly connected to the two positioning grooves. Each positioning board includes a positioning bump. The positioning bump is inserted in the concave portion from the first guiding groove or the second guiding groove to fix the second insulating body at the first insulating body. The plurality of metal pins is disposed at an interval between the two positioning boards. When the positioning bumps are inserted in the concave portions, the metal pins are individually plugged in the terminal grooves to be connected electrically to the conductive terminals.

Finally, the electric connector of the present invention may be further applied in a lithium battery and a circuit board to provide the lithium battery and the circuit board with another manner of electric connection.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
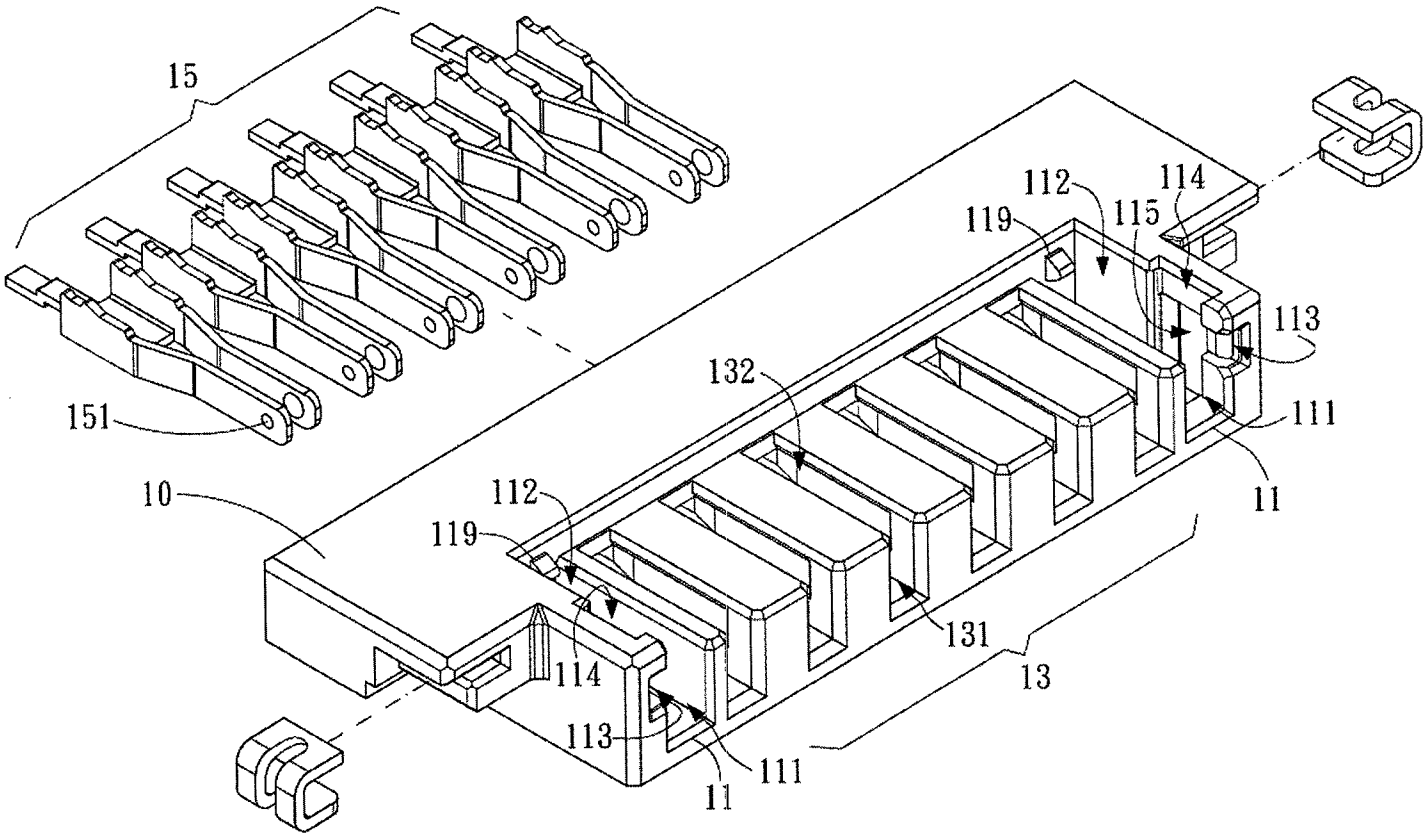
FIG. 1 is a schematic diagram (1) of an electric connector according to the present invention.

Please refer to FIG. 1 to FIG. 4, which are a schematic diagram (1), a schematic diagram (2), a schematic diagram (1) of plugging in a first direction, and a schematic diagram (2) of plugging in a second direction of an electric connector according to the present invention, respectively. The electric connector of the present invention includes a first insulating body 10 and a plurality of conductive terminals 15. The first insulating body 10 includes two positioning grooves 11 and a plurality of terminal grooves 13. Each positioning groove 11 has a first socket 111 and a second socket 112. A first guiding groove 113, a second guiding groove 114, and a concave portion 115 are disposed at a groove wall of each positioning groove 11. The first guiding groove 113 extends from the first socket 111 in a first direction 80 to the concave portion 115. The second guiding groove 114 extends from the second socket 112 in a second direction 90 to the concave portion 115. The terminal grooves 13 are disposed at an interval between the two positioning grooves 11. Each terminal groove 13 has a third socket 131 and a fourth socket 132. The plurality of conductive terminals 15 is disposed individually in the terminal grooves 13.

Figure 2:
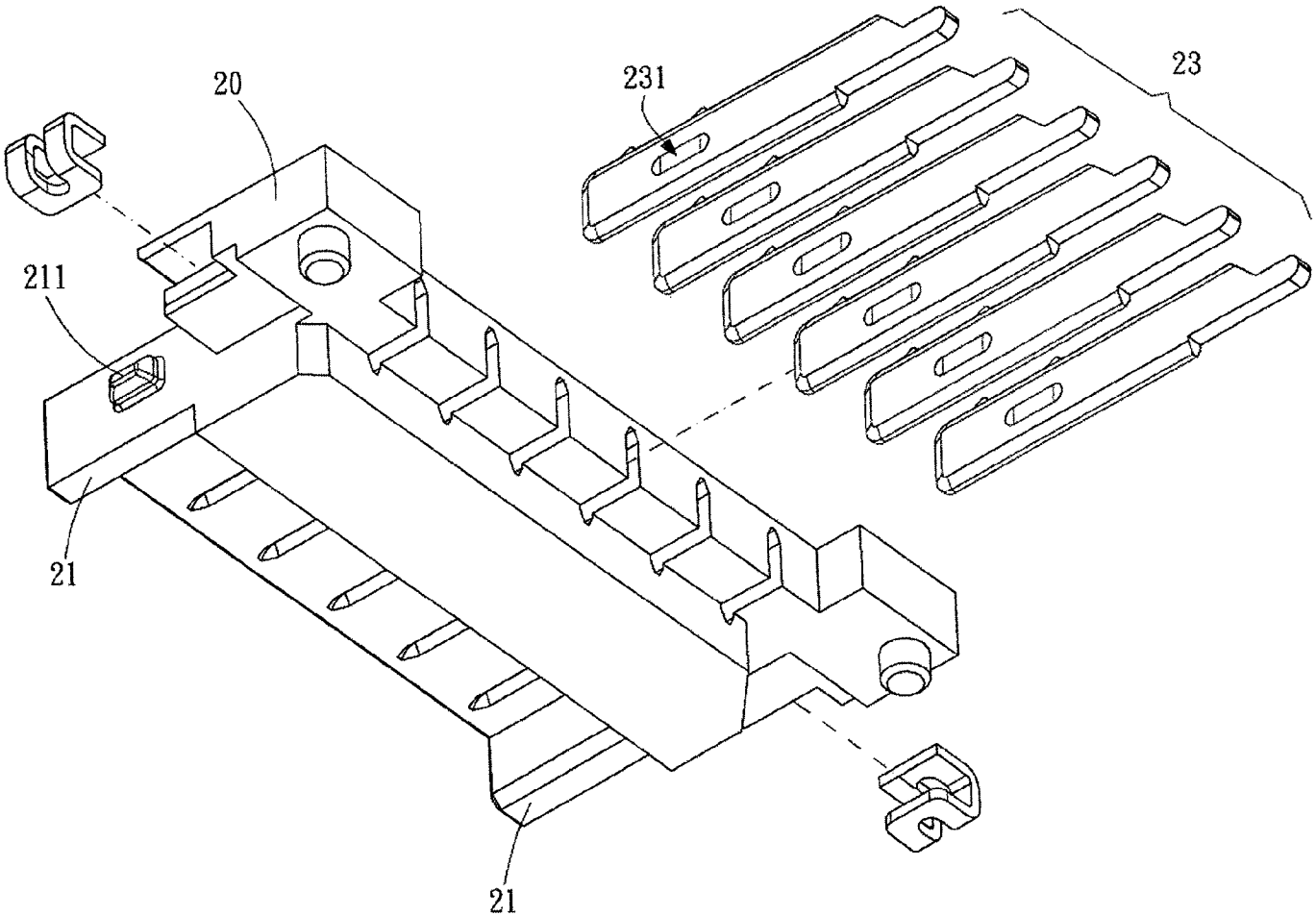
FIG. 2 is a schematic diagram (2) of an electric connector according to the present invention.
Figure 3:
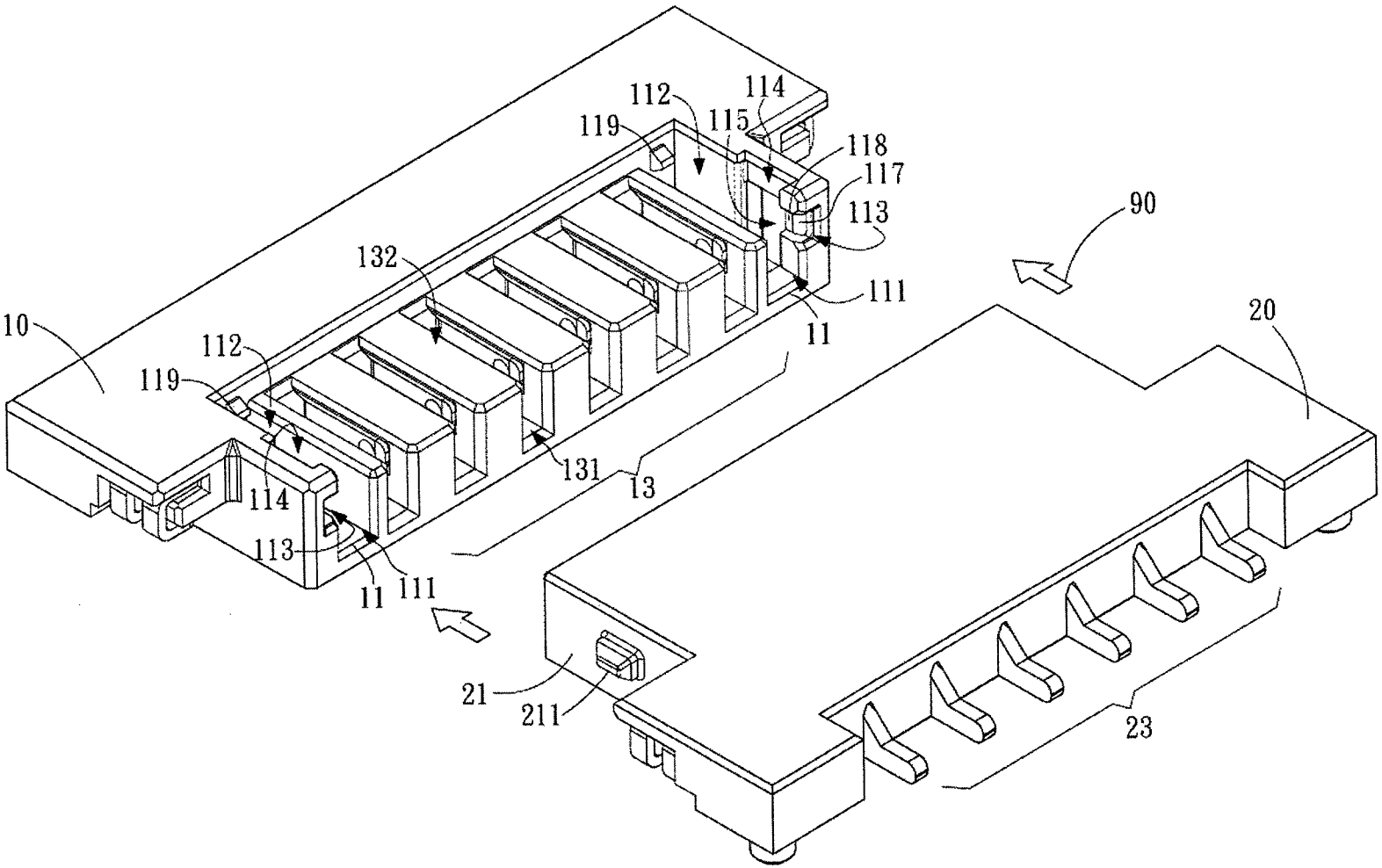
FIG. 3 is a schematic diagram (1) of plugging in a first direction of an electric connector according to the present invention.
Figure 4:
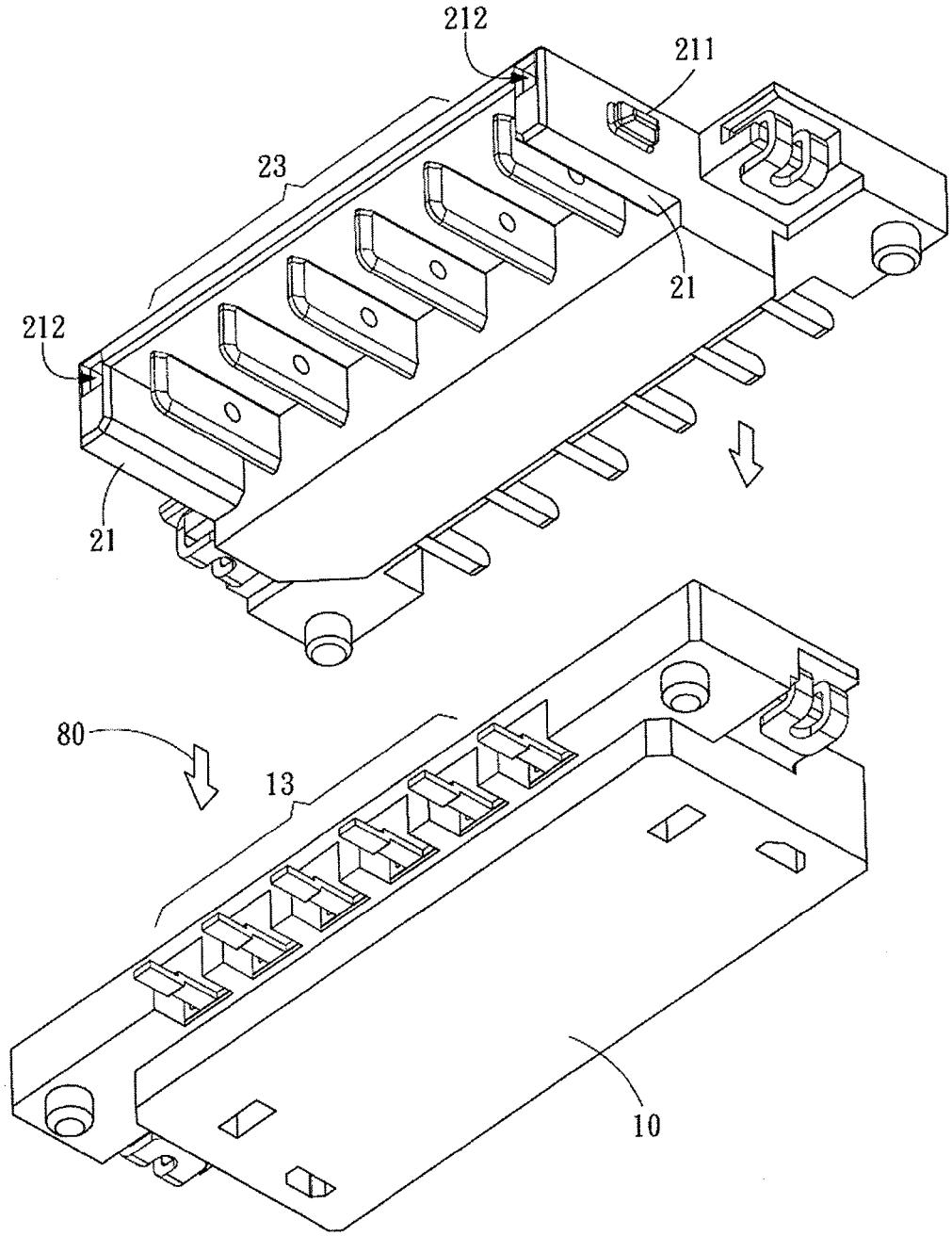
FIG. 4 is a schematic diagram (2) of plugging in a second direction of an electric connector according to the present invention.

In one implementation aspect, the electric connector of the present invention further includes a second insulating body 20 and a plurality of metal pins 23, as shown in FIG. 2. Two positioning boards 21 are included at two sides of the second insulating body 20 and are correspondingly connected to the two positioning grooves 11. Each positioning board 21 includes a positioning bump 211. The positioning bump 211 is inserted in the concave portion 115 from the first guiding groove 113 (as shown in FIG. 3), or the second guiding groove 114 (as shown in FIG. 4), to fix the second insulating body 20 at the first insulating body 10. The plurality of metal pins 23 is disposed at an interval between two positioning boards 21. When the positioning bumps 211 are inserted in the concave portions 115, the plurality of metal pins 23 is individually plugged in the terminal grooves 13 to be connected electrically to the conductive terminals 15.

In one implementation aspect, the first insulating body 10 further includes two positioning bumps 119 separately disposed at the groove walls of the two positioning grooves 13. Each positioning board 21 further includes a positioning hole 212. When the two positioning boards 21 are correspondingly connected to the two positioning grooves 11, the two positioning bumps 119 of the first insulating body 10 are individually inserted in positioning holes 212 of the two positioning boards 21. As the positioning bumps 119 are disposed, the first insulating body 10 and the second insulating body 20 do not easily rotate relative to each other when being connected, and thus are not easily detached from each other due to an external force.

In one implementation aspect, the first guiding groove 113 has a slope 117 and a plane 118 connected to the slope 117. The two positioning bumps 211 of the two positioning boards 21 are plugged from the first sockets 111, pass through the slopes 117 and the planes 118 in sequence, and are inserted in the concave portions 115.

In one implementation aspect, the second guiding groove 114 has a slope and a plane connected to the slope. The two positioning bumps 211 of the two positioning board 21 are inserted in the concave portions 115 from the second sockets 112, the slopes and the planes in sequence.

In one implementation aspect, a terminal bulge 151 is disposed at an end of each conductive terminal 15. A terminal sliding groove 231 is disposed at an end of each metal pin 23. When the two positioning boards 21 are correspondingly connected to two positioning grooves 11, the terminal bulges 151 are inserted in the terminal sliding grooves 231.

Finally, the electric connector of the present invention can be further applied in a lithium battery and a circuit board. For example, the first insulating body 10 and the conductive terminals 15 are disposed on the lithium battery, and the second insulating body 20 and the metal pins 23 are disposed on the circuit board, so that the lithium battery can be plugged in the circuit board in the first direction 80 or the second direction 90 to be connected electrically thereto, thus mitigating the problems in the conventional connection of a lithium battery and a circuit board by using the soldering technology.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electric connector, comprising:

a first insulating body, comprising two positioning grooves and a plurality of terminal grooves, each positioning groove having a first socket and a second socket, a first guiding groove, a second guiding groove, and a concave portion being disposed at a groove wall of each positioning groove, the first guiding groove extending from the first socket in a first direction to the concave portion, and the second guiding groove extending from the second socket in a second direction to the concave portion; and the terminal grooves being disposed at an interval between the two positioning grooves, and each terminal groove having a third socket and a fourth socket; and a plurality of conductive terminals, disposed individually in the terminal grooves.

2. The electric connector according to claim 1, further comprising:

a second insulating body, comprising two positioning boards correspondingly connected to the two positioning grooves, each positioning board comprising a positioning bump, the positioning bump being inserted in the concave portion from the first guiding groove or the second guiding groove to fix the second insulating body at the first insulating body; and a plurality of metal pins, disposed at an interval between the two positioning boards, wherein when the positioning bumps are inserted in the concave portions, the metal pins are individually plugged in the terminal grooves to be connected electrically to the conductive terminals.

3. The electric connector according to claim 2, wherein the first insulating body further comprises two positioning bumps separately disposed at the groove walls of the two positioning grooves; each positioning board further comprises a positioning hole, and when the two positioning boards are correspondingly connected to the two positioning grooves, the two positioning bumps of the first insulating body are individually inserted in the positioning holes of the two positioning boards.

4. The electric connector according to claim 2, wherein the first guiding groove has a slope and a plane connected to the slope, and the two positioning bumps of the two positioning boards are plugged from the first sockets, pass through the slopes and the planes in sequence, and are inserted in the concave portions.

5. The electric connector according to claim 2, wherein the second guiding groove has a slope and a plane connected to the slope, and the two positioning bumps of the two positioning boards are plugged from the second sockets, pass through the slopes and the planes in sequence, and are inserted in the concave portions.

6. The electric connector according to claim 2, wherein a terminal bulge is disposed at an end of each conductive terminal.

7. The electric connector according to claim 6, wherein a terminal sliding groove is disposed at an end of each metal pin, and when the two positioning boards are correspondingly connected to the two positioning grooves, the terminal bulges are inserted in the terminal sliding grooves.

* * * * *